US008989565B2

(12) United States Patent
Hayashi et al.

(10) Patent No.: US 8,989,565 B2
(45) Date of Patent: Mar. 24, 2015

(54) MULTISTAGE FURNACE

(71) Applicants: Koji Hayashi, Tatebayashi (JP); Taichi Shimizu, Midori (JP)

(72) Inventors: Koji Hayashi, Tatebayashi (JP); Taichi Shimizu, Midori (JP)

(73) Assignee: TOA Industries Co., Ltd., Ota-shi (JP)

( * ) Notice: Subject to any disclaimer, the term of this patent is extended or adjusted under 35 U.S.C. 154(b) by 258 days.

(21) Appl. No.: 13/800,950

(22) Filed: Mar. 13, 2013

(65) Prior Publication Data

US 2014/0099085 A1 Apr. 10, 2014

(30) Foreign Application Priority Data

Oct. 9, 2012 (JP) ..... 2012-224148
Oct. 9, 2012 (JP) ..... 2012-224149

(51) Int. Cl.

| | |
|---|---|
| ***F26B 19/00*** | (2006.01) |
| ***F27D 11/12*** | (2006.01) |
| ***F27D 99/00*** | (2010.01) |
| ***F27D 9/00*** | (2006.01) |
| ***F27B 9/02*** | (2006.01) |
| ***F27B 9/06*** | (2006.01) |
| ***F27B 9/24*** | (2006.01) |
| ***F27B 9/38*** | (2006.01) |
| ***F27B 9/39*** | (2006.01) |
| ***F27B 9/40*** | (2006.01) |

(52) U.S. Cl.

CPC ..... *F27D 11/12* (2013.01); *F27D 99/00* (2013.01); *F27D 9/00* (2013.01); *F27B 9/021* (2013.01); *F27B 9/063* (2013.01); *F27B 9/2469* (2013.01); *F27B 9/38* (2013.01); *F27B 9/39* (2013.01); *F27B 9/40* (2013.01)

USPC ..... 392/416; 392/417; 392/418

(58) Field of Classification Search

None

See application file for complete search history.

(56) References Cited

FOREIGN PATENT DOCUMENTS

| | | |
|---|---|---|
| JP | 2001-317872 | 11/2001 |
| JP | 2005-156016 | 6/2005 |
| JP | 2010-044875 | 2/2010 |

*Primary Examiner* — Thor Campbell

(74) *Attorney, Agent, or Firm* — Morrison & Foerster LLP

(57) ABSTRACT

The invention provides a compact multistage furnace of which the installation area in a factory is decreased. A multistage furnace is configured by piling up a plurality of furnace units in the vertical direction. Each of the furnace units includes an upper heater and a lower heater layered in the vertical direction and holding a heat insulator therebetween, a support pipe disposed on one end of the upper heater and extending in the horizontal direction, a support pipe disposed on other end of the upper heater and extending in the horizontal direction, and a plurality of work support bars mounted over the support pipes. The back surface of a work supported by the work support bars is opposed to the upper heater and the front surface of the work is opposed to the lower heater of the adjacent furnace unit disposed above.

6 Claims, 10 Drawing Sheets

MULTISTAGE FURNACE

CROSS-REFERENCE OF THE INVENTION

This application claims priority from Japanese Patent Application Nos. 2012-224148 and 2012-224149, the contents of which are incorporated herein by reference in their entireties.

BACKGROUND OF THE INVENTION

1. Field of the Invention

The invention relates to a multistage furnace in which a plurality of furnace units are piled up in the vertical direction.

2. Description of the Related Art

For vehicle components, a thinned and high-strength member is used so as to enhance both the safety and economy. For this purpose, so-called hot press is known in which a steel plate heated to high temperature is quenched by cooling the plate with low-temperature press dies. In this method, a steel plate is heated to transformation temperature or higher at which the metal structure of the steel member is transformed into austenite, and the steel plate is formed and rapidly cooled with press dies simultaneously, completing quenching.

As a furnace for hot press, as shown in FIG. 11, one is known in which a multiple number of lower heaters 1 and upper heaters 2 are arrayed in the horizontal direction and a steel plate W is carried and heated between the lower heaters 1 and the upper heaters 2 from the inlet to the outlet. Steel plates W are sequentially inserted into the furnace from the inlet thereof, and heated between the lower heaters 1 and the upper heaters 2 until these are discharged from the outlet. A relevant technique is disclosed in Japanese Patent Application Publication No. 2010-44875.

The conventional furnace heats a plurality of steel plates W sequentially, but the multiple number of lower heaters 1 and upper heaters 2 arrayed in the horizontal direction make the installation area of the furnace large in a factory. Furthermore, even when only one of the multiple number of lower heaters 1 and upper heaters 2 is broken due to burnout or the like, all the steel plates W inserted in the furnace become defective products due to underheating.

SUMMARY OF THE INVENTION

To solve the described problem, the invention provides a multistage furnace including a plurality of furnace units piled up in a vertical direction, the furnace units each including: upper and lower heaters having plate shapes layered in the vertical direction; a first support pipe disposed on one end of the upper heater and extending in a horizontal direction; a second support pipe disposed on other end of the upper heater and extending in the horizontal direction; and a plurality of work support bars disposed over the first and second support pipes so as to support a work, wherein a back surface of a work supported by the plurality of work support bars is opposed to the upper heater and a front surface of the work is opposed to a lower heater of an adjacent furnace unit disposed above.

DETAILED DESCRIPTION OF THE INVENTION

Figure 1:
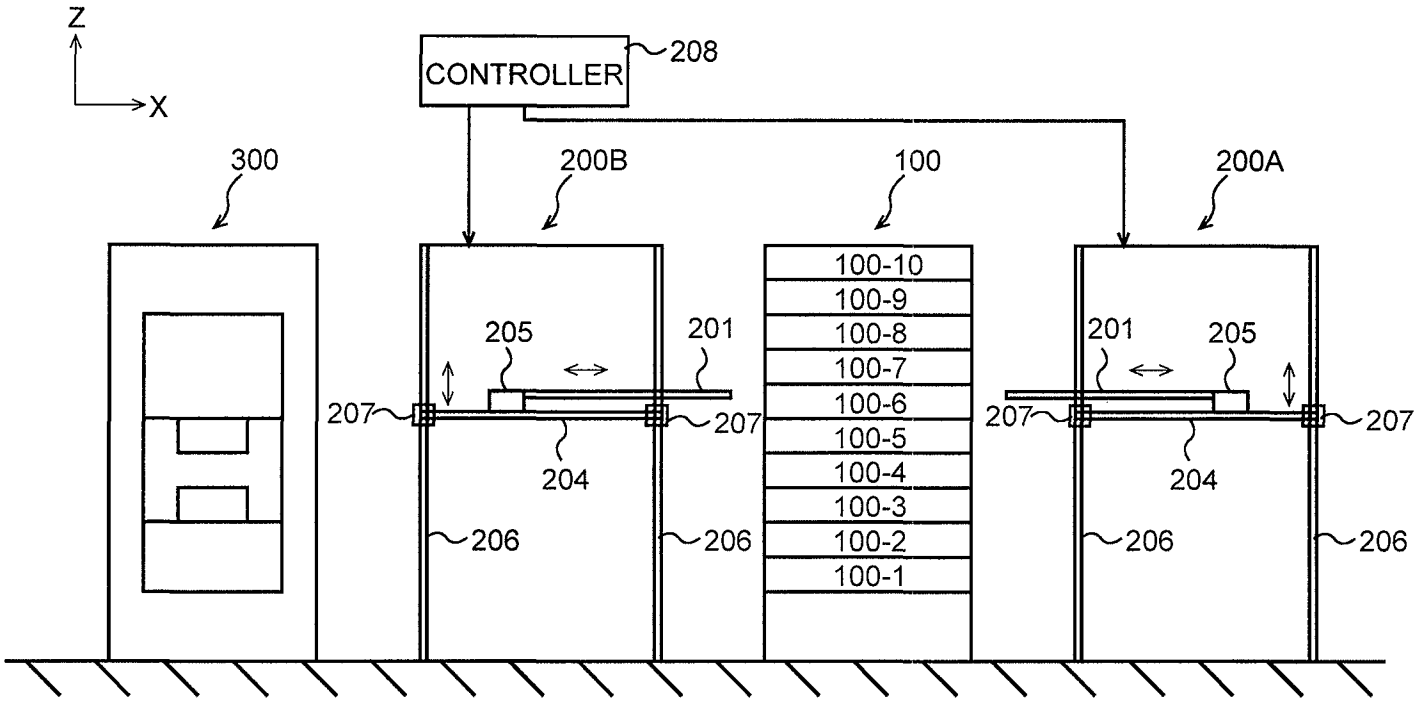
FIG. 1 is a view showing all installations for hot press.

FIG. 1 is a view showing all installations for hot press. As shown in FIG. 1, a multistage furnace 100, two work carrier machines 200A and 200B, and a press machine 300 having press dies are disposed. The work carrier machine 200A is disposed on the inlet side of the multistage furnace 100 so as to insert works such as a steel plate into the multistage furnace 100, and the work carrier machine 200B is disposed on the outlet side of the multistage furnace 100 so as to discharge works from the multistage furnace 100.

The multistage furnace 100 is configured by piling a plurality of furnace units in the vertical direction. In this example, ten furnace units 100-1 to 100-10 are piled up.

The work carrier machine 200A for insertion and the work carrier machine 200B for discharge have the same structures basically, each of which has a plurality of work carrier bars 201, a horizontal motion mechanism 205 connecting the ends of the plurality of work carrier bars 201 and moving these on horizontal rails 204, and a vertical motion mechanism 207 moving the horizontal rails 204 on vertical rails 206. A controller 208 such as CPU that controls the operations of the horizontal motion mechanism 205, the vertical motion mechanism 207 and so on is further provided.

This enables a work to move in the horizontal and vertical directions, being supported on the plurality of work carrier bars 201, and the work is inserted in any one furnace unit 100-X of the multistage furnace 100 together with the plurality of work carrier bars 201 of the work carrier machine 200A for insertion. The work inserted in the furnace unit 100-X is heated to an austenitizing temperature or higher.

When the heating of the work is completed, the plurality of work carrier bars 201 of the work carrier machine 200B for discharge are inserted in the furnace unit 100-X of the multistage furnace 100 and the work is discharged from the multistage furnace 100, being supported on the plurality of work carrier bars 201. Then, the work discharged from the multistage furnace 100 is formed and cooled rapidly by the press dies of the press machine 300, thereby completing quenching.

Hereafter, the structures of the multistage furnace 100, and the work carrier machines 200A and 200B will be described.

<Structure of Multistage Furnace 100>

Figure 2:
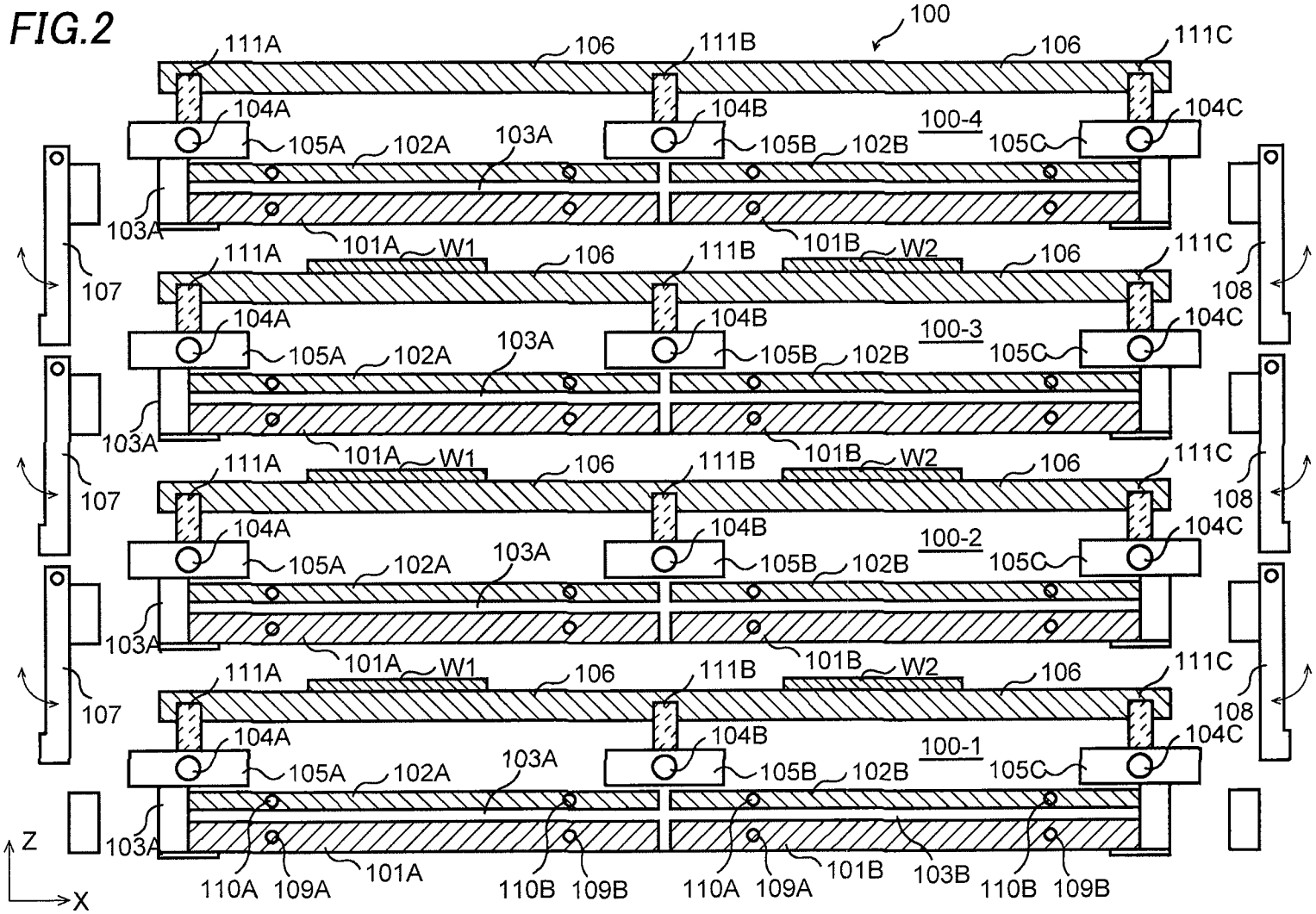
FIG. 2 is a front view of a multistage furnace in an embodiment of the invention.
Figure 3:
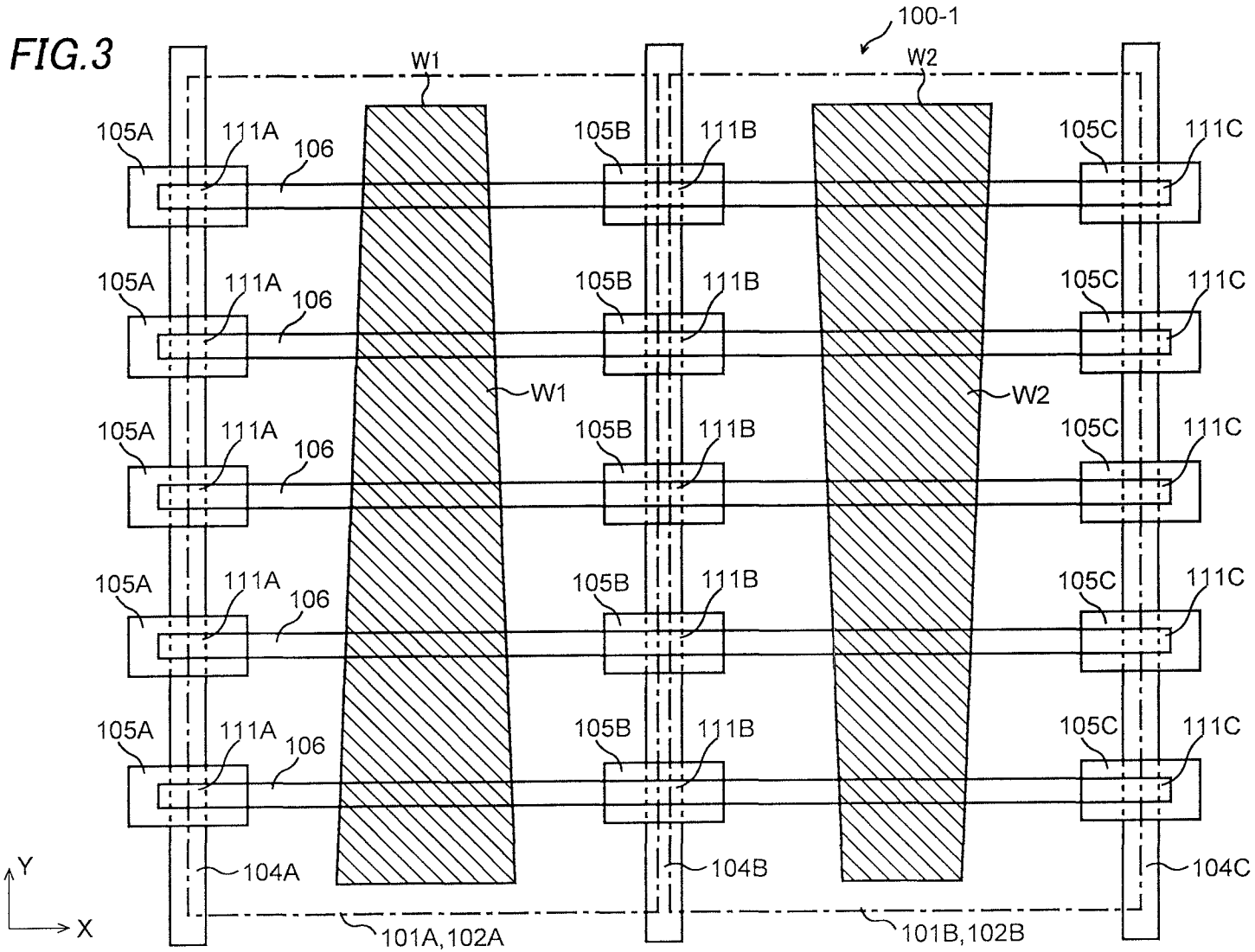
FIG. 3 is a plan view of one of the furnace units of the multistage furnace in FIG. 2.
Figure 4:
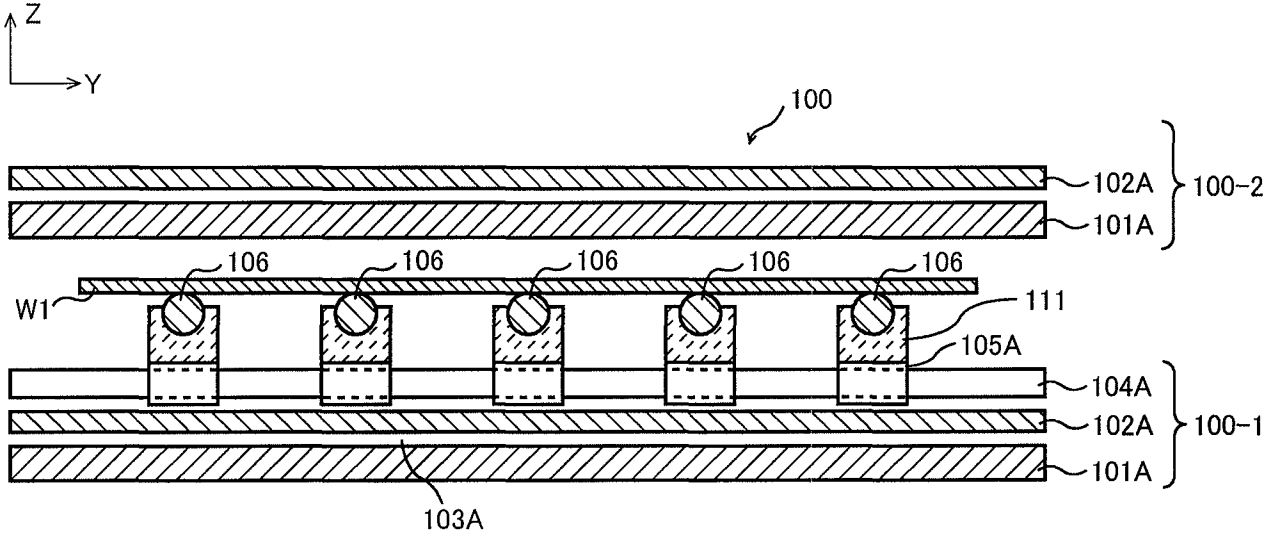
FIG. 4 is a left side view of FIG. 3.

FIG. 2 is a front view of the multistage furnace 100, FIG. 3 is a plan view of one furnace unit of the multistage furnace of FIG. 2, and FIG. 4 is a left side view of FIG. 3. In FIG. 2, only four furnace units 100-1 to 100-4 are shown.

The furnace units 100-1 to 100-10 have the same structures basically. Two plate-shaped lower heaters 101A and 101B are provided adjoining in the horizontal direction on the bottom portion of the furnace unit 100-1. Upper heaters 102A and 102B are layered on the lower heaters 101A and 101B respectively so that the upper heaters 102A and 102B and the lower heaters 101A and 101B are opposed to each other, holding heat insulators 103A and 103B therebetween. A pair of electrodes 109A and 109B for power supply are provided on each of the lower heaters 101A and 101B, and a pair of electrodes 110A and 110B for power supply are provided on each of the upper heaters 102A and 102B. It is preferable that the lower heaters 101A and 101B and the upper heaters 102A and 102B are far-infrared heaters that emit far-infrared radiation.

A support pipe 104A is provided near the inlet of the furnace unit 100-1 on the left side in FIG. 2, extending on one end portion of the upper heater 102A in a horizontal direction (Y direction). A support pipe 104B is provided near the center of the furnace unit 100-1, extending on end portions of the upper heaters 102A and 102B in the horizontal direction (Y direction). Furthermore, a support pipe 104C is provided near the outlet of the furnace unit 100-1 on the right side in FIG. 2, extending on one end portion of the upper heater 102B in the horizontal direction (Y direction). The support pipes 104A, 104B and 104C are made of metal and have cylindrical shapes.

The support pipe 104A is inserted in a plurality of bases 105A (e.g. five bases) provided at predetermined intervals. The support pipes 104B and 104C are also inserted in the bases 105B and 105C in the similar manner, respectively.

Support stands 111A, 111B and 111C are provided standing on the bases 105A, 105B and 105C, respectively. A concave portion having a semicircle cross section is formed in the upper surfaces of the support stands 111A, 111B and 111C. A plurality of work support bars 106 (e.g., five bars) are mounted over the three support pipes 104A to 104C, extending in a horizontal direction (X direction). In this case, the work support bars 106 are metallic columns or cylinders, and fitted in the concave portions of the support stands 111A, 111B and 111C.

Two works W1 and W2 inserted from the inlet by the work carrier machine 200A are supported on these work support bars 106. Each of the works W1 and W2 is a vehicle component, for example, and made of a steel plate having a predetermined shape. Furthermore, an inlet door 107 and an outlet door 108 that are openable and closable are provided on the inlet and outlet of the furnace unit 100-1, respectively.

The furnace unit 100-1 is stored in a housing, and the furnace unit 100-2 having the same structure is mounted thereon. Furthermore, the furnace units 100-3 to 100-10 are sequentially piled up thereon.

In this case, the back surface of the work W1 inserted in the furnace unit 100-1 is opposed to the upper heater 102A, and the front surface of the work W1 is opposed to the lower heater 101A of the adjacent furnace unit 100-2 on the second stage disposed above. Furthermore, the back surface of the work W2 inserted in the furnace unit 100-1 is opposed to the upper heater 102B, and the front surface of the work W2 is opposed to the lower heater 101B of the adjacent furnace unit 100-2 on the second stage disposed above.

As described above, since the multistage furnace 100 is configured by piling up the furnace units 100-1 to 100-10 in the vertical direction, the installation area is decreased to save the space in a factory. Furthermore, since each of the furnace units functions as an independent furnace, even when one furnace unit is broken, the other furnace units are not influenced by it. The number of the furnace units may be increased or decreased according to need depending on a required number of products.

The multistage furnace 100 has such a structure that the lower heaters 101A and 101B and the upper heaters 102A and 102B are layered on each of the bottom portions of the furnace units 100-1 to 100-10 and hold the heat insulators 103A and 103B therebetween respectively, and the work support bars 106 are mounted over the upper heaters 102A and 102B. Therefore, the sizes of the furnace units 100-1 to 100-10 are decreased in the vertical direction to make the multistage furnace 100 compact as a whole.

In each of the furnace units 100-1 to 100-10, the two lower heaters 101A and 101B and the two upper heaters 102A and 102B are provided so as to insert two works W1 and W2 respectively and correspondingly. However, the number of the heaters may be increased or decreased depending on the number of works to be inserted, and the number of the support pipes and the number of the work support bars may be increased or decreased correspondingly.

Since the lower heaters 101A and 101B of the furnace unit 100-1 on the lowest stage and the upper heaters 102A and 102B of the furnace unit 100-10 on the highest stage have no work to heat, these may be replaced by unused dummy heaters or removed so as to save the electric power.

Furthermore, since the loads of the works W1 and W2 and the work support bars 106 are applied to the support pipes 104A, 104B and 104C, the support pipes 104A, 104B and 104C are easy to deform by the heating of the furnace units 100-1 to 100-10. If the heat deformations of the support pipes 104A, 104B and 104C occur, the works W1 and W2 may shift out of position or fall. Therefore, by flowing cooling water through the support pipes 104A, 104B and 104C, the heat deformations are prevented.

Figure 10A:
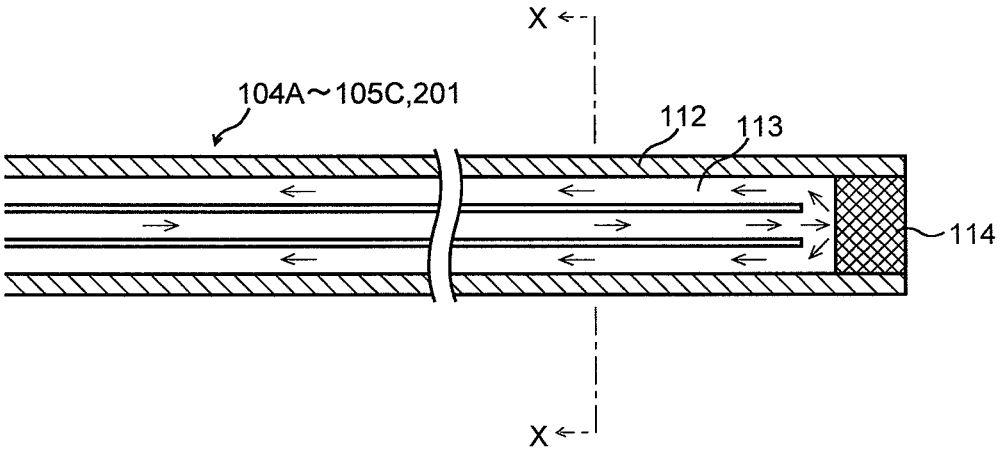
FIGS. 10A and 10B are cross-sectional views of a support pipe and a work carrier bar.
Figure 10B:
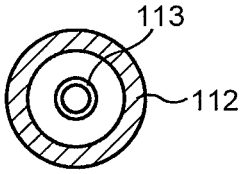
Figure 11:
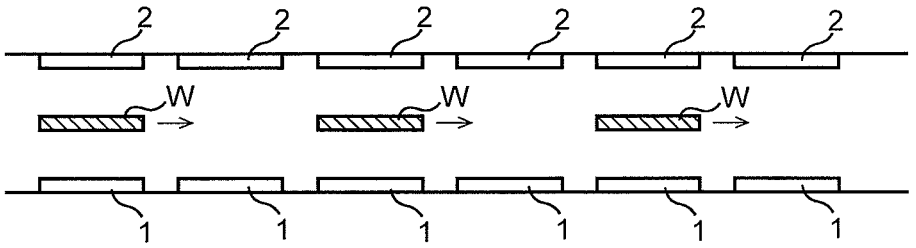
FIG. 11 is a view showing a conventional furnace.

FIGS. 10A and 10B are cross-sectional views showing the structure of the support pipes 104A, 104B and 104C, and FIG. 10B is a cross-sectional view of FIG. 10A along line X-X. As shown in FIGS. 10A and 10B, each of the support pipes 104A to 104C includes an outer pipe 112 of which one end is closed by a stopper 114 and the other end is open, and an inner pipe 113 inserted in the outer pipe 112 with a space therebetween, of which both the ends are open. Cooling water is injected into the inner pipe 113 from the opening of the inner pipe 113 by cooling water injecting device such as a water tap. The cooling water injected into the inner pipe 113 hits the stopper 114, flows back in the reverse direction through the space, and is collected. This structure doubles the path of cooling water to provide a high cooling effect and save the piping of cooling water.

<Structure of Work Carrier Machines 200A and 200B>

As described above, the work carrier machine 200A is used for inserting works W1 and W2 into the multistage furnace 100 and the work carrier machine 200B is used for discharging the works W1 and W2 from the multistage furnace 100, and both the machines have the same structures.

Figure 5:
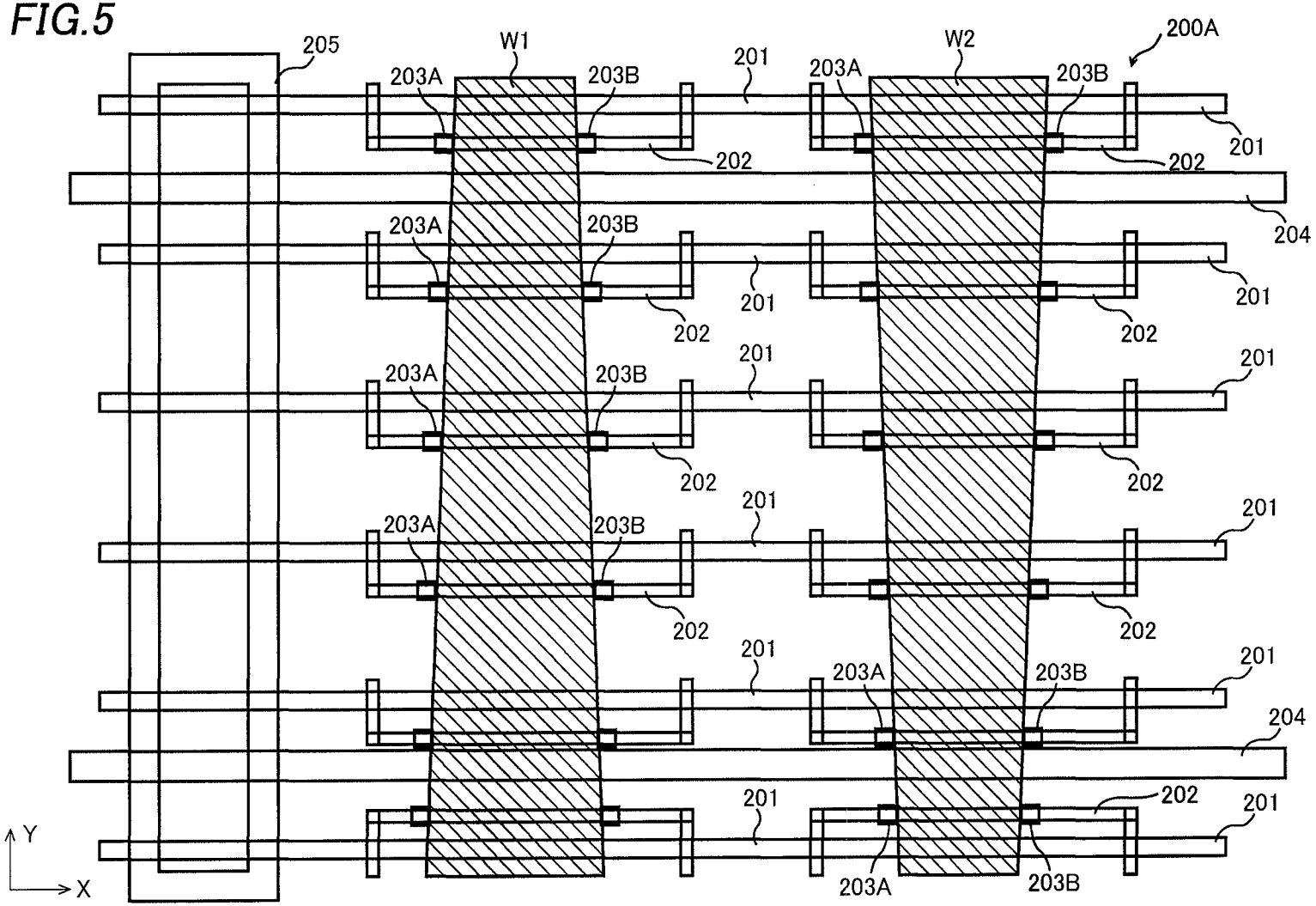
FIG. 5 is a plan view of a work carrier machine.
Figure 6:
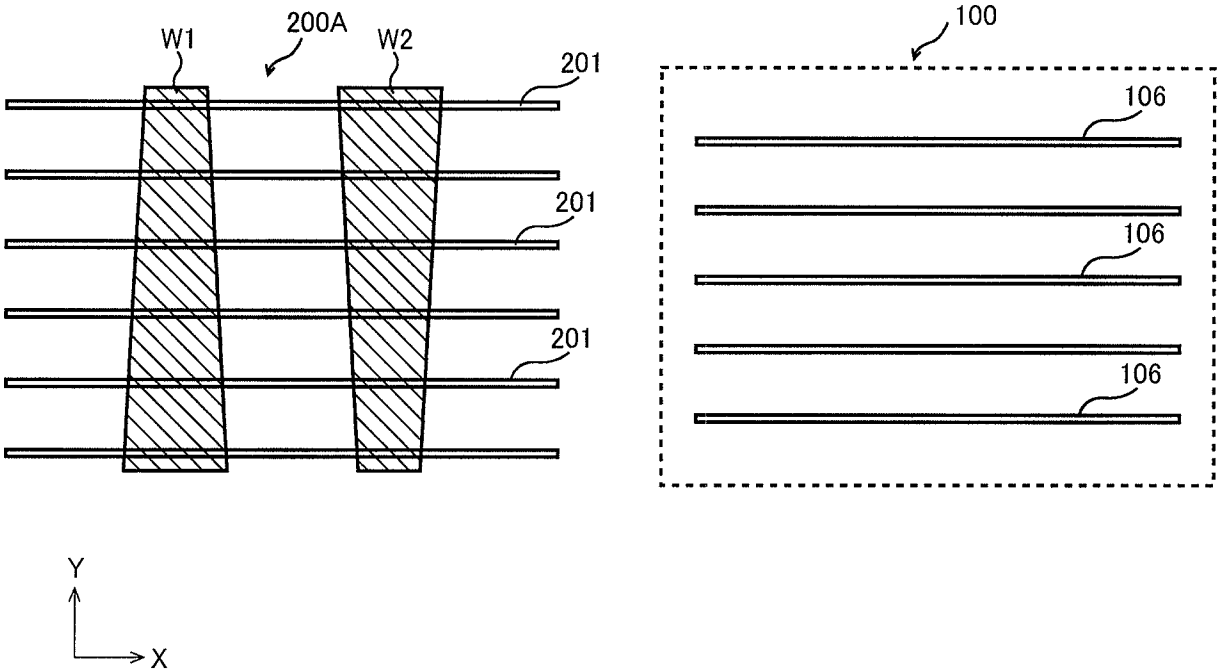
FIG. 6 is a first plan view showing a state of carrying works by the work carrier machine.
Figure 7:
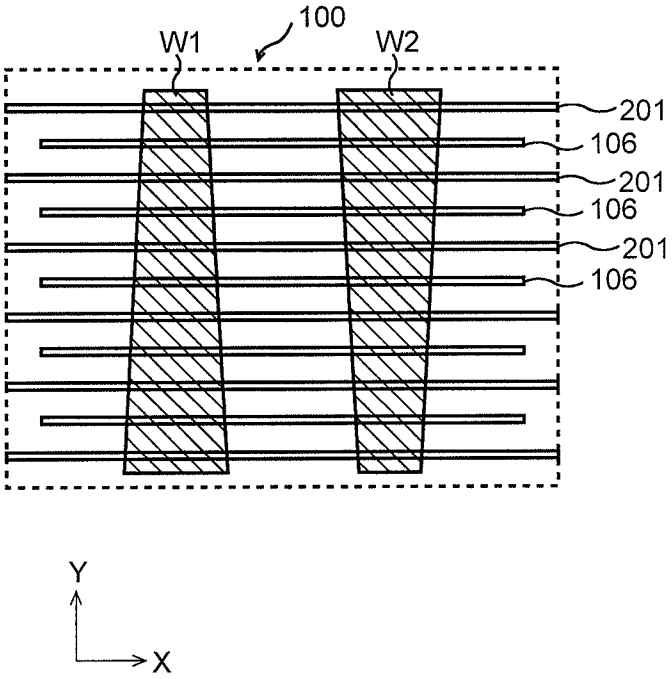
FIG. 7 is a second plan view showing a state of carrying works by the work carrier machine.
Figure 8:
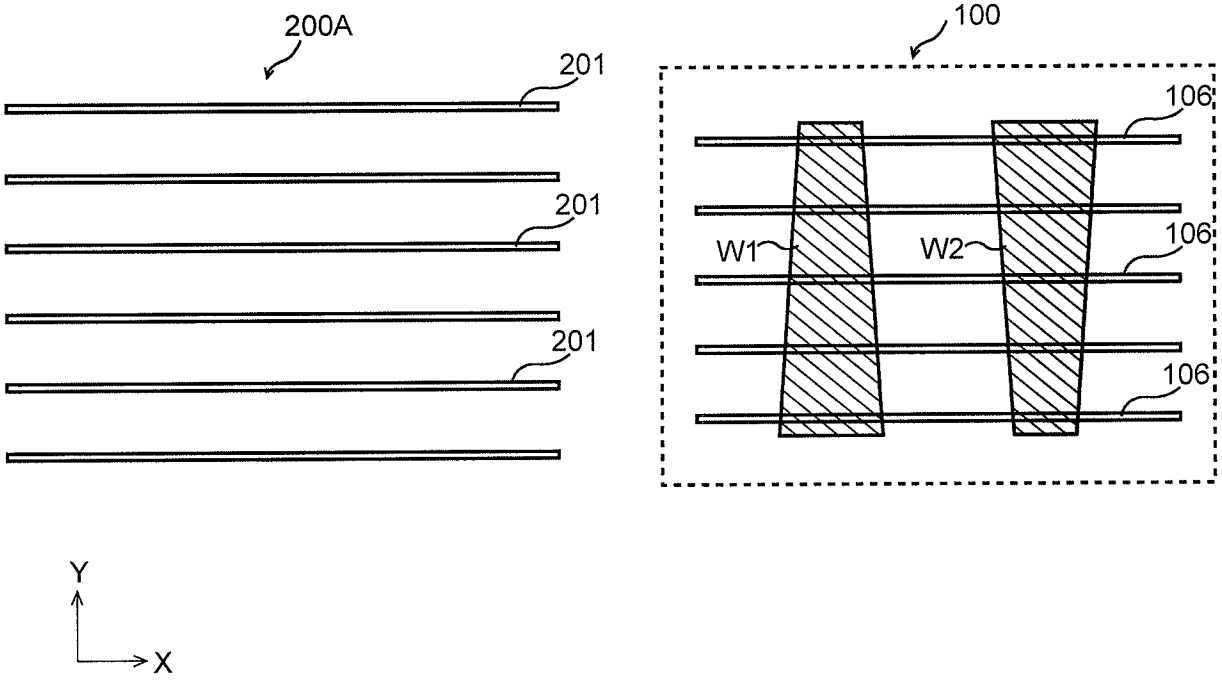
FIG. 8 is a third plan view showing a state of carrying works by the work carrier machine.
Figure 9A:
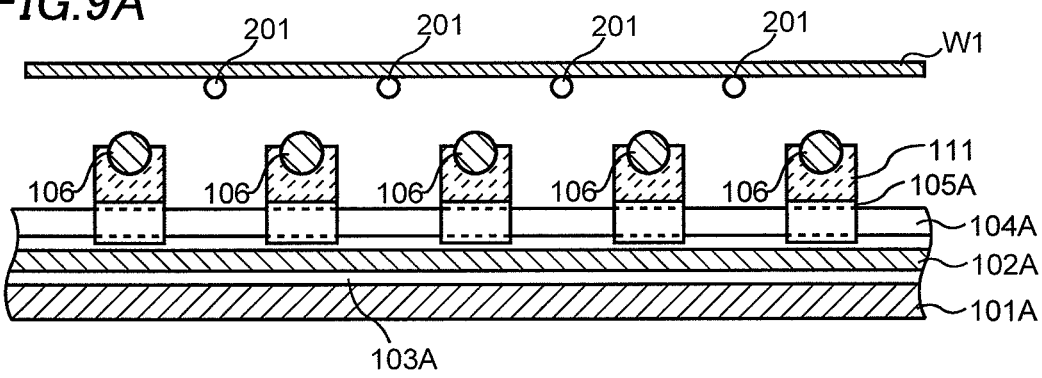
FIGS. 9A, 9B and 9C are side views showing a state of carrying a work by the work carrier machine.
Figure 9B:
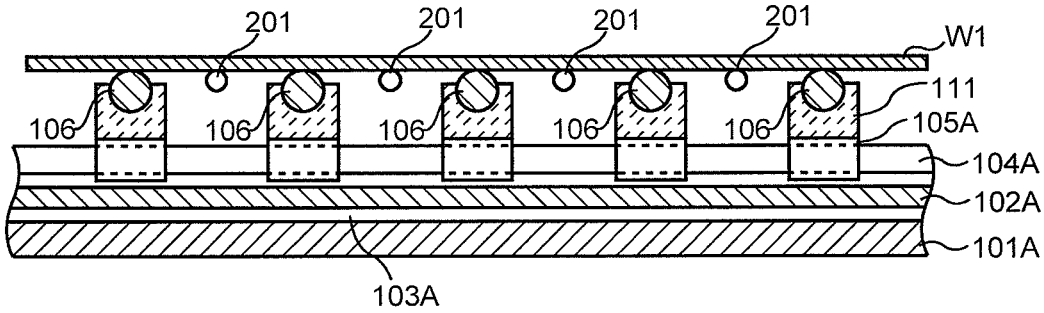
Figure 9C:
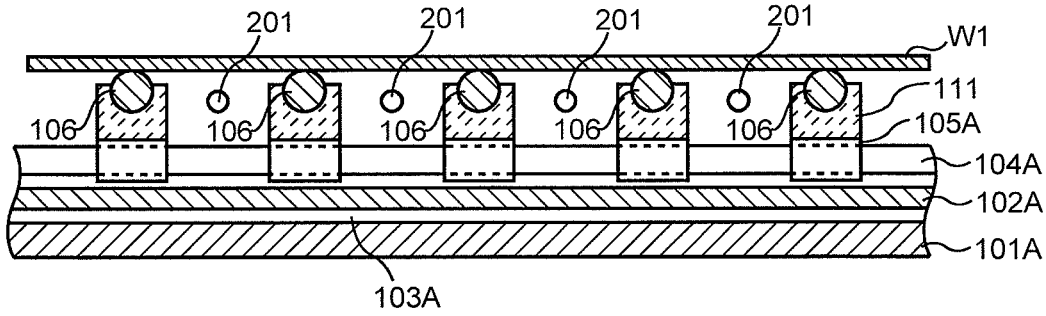

FIG. 1 is a front view of the work carrier machine 200A, and FIG. 5 is a plan view of the work carrier machine 200A, and FIGS. 6 to 8 are plan views showing a state of carrying works by the work carrier machine 200A. FIGS. 9A, 9B and 9C are side views showing a state of carrying a work by the work carrier machine 200A.

The work carrier machine 200A includes a plurality of work carrier bars 201 (e.g., 6 bars) extending in the horizontal direction, the horizontal motion mechanism 205 connecting the ends of these work carrier bars 201 and moving these on the horizontal rails 204, and the vertical motion mechanism 207 (ref. FIG. 1) moving the body of the work carrier machine including the horizontal rails 204 on the vertical rails 206.

The horizontal motion mechanism 205 and the vertical motion mechanism 207 include wheels running on the horizontal rails 204 and the vertical rails 206 respectively, and motors driving and rotating the wheels.

The works W1 and W2 are supported on predetermined positions of the six work carrier bars 201, but only by this support, the works W1 and W2 may shift out of position or fall while the work carrier bars 201 are moving. To prevent this, a pair of guide bars 202 are mounted on each of the work carrier bars 201, parallel with each other. The pair of guide bars 202 are parallel to the corresponding work carrier bars 201.

A pair of work restriction components 203A and 203B formed in a ring shape is attached to each of the guide bars 202, and the work restriction components 203A and 203B are positioned corresponding to the planar shape of the works W1 and W2 and hold each of the works W1 and W2 from both the sides to restrict the motions.

The operation of the work carrier machine 200A will be described referring to FIGS. 6 to 9C. The operations of the horizontal motion mechanism 205 and the vertical motion mechanism 207 are controlled by the controller 208. First, as shown in FIG. 6, works W1 and W2 are mounted on the work carrier bars 201 and the motions of the works W1 and W2 are restricted by the work restriction components 203A and 203B. Then, by the vertical motion mechanism 207, the body of the work carrier machine is moved in the vertical direction to the height of one furnace unit to insert the works W1 and W2.

Then, as shown in FIG. 7 and FIG. 9A, the six work carrier bars 201 are horizontally moved in the X direction by the horizontal motion mechanism 205 so as to be inserted between the five work support bars 106 of the furnace unit.

Then, as shown in FIG. 9B, by moving the six work carrier bars 201 downward by the vertical motion mechanism 207, the works W1 and W2 mounted on the work carrier bars 201 are transferred onto the work support bars 106. Then, as shown in FIG. 9C, the work carrier bars 201 are further moved downward by the vertical motion mechanism 207, and the work carrier bars 201 are moved away from the works W1 and W2 into spaces surrounded by the works W1 and W2 and the support stands 111A, 111B and 111C. Then, as shown in FIG. 8, the work carrier bars 201 are pulled out from the furnace unit by the horizontal motion mechanism 205.

In this manner, the works W1 and W2 are inserted into any one of the furnace units of the multistage furnace 100 by using the work carrier bars 201. As described above, the furnace unit has such a structure that the size in the vertical direction is small, and the works W1 and W2 are stored in a narrow space between the work support bars 106 and the lower heaters 101A and 101B disposed above. The work carrier machine 200A is suitable for inserting the works W1 and W2 into such a narrow space by using the work carrier bars 201.

The work carrier machine 200B also uses the work carrier bars 201 in the similar manner so as to discharge the works W1 and W2 from any one of the furnace units of the multistage furnace 100.

Furthermore, since the work carrier bars 201 are inserted into the high-temperature furnace unit, the work carrier bars 201 are easy to deform by heat. If the heat deformations of the work carrier bars 201 occur, the works W1 and W2 may shift out of position or fall. In the similar manner to the support pipes 104A, 104B and 104C described above, the heat deformations of the work carrier bars 201 are prevented by flowing cooling water therethrough.

In this case, too, as shown in FIG. 10, the work carrier bar 201 includes an outer pipe 112 of which one end is closed by a stopper 114 and the other end is open, and an inner pipe 113 inserted in the outer pipe 112 with a space therebetween, of which both the ends are open. Cooling water is injected into the inner pipe 113 from the opening of the inner pipe 113 by cooling water injecting device such as a water tap. The cooling water injected into the inner pipe 113 hits the stopper 114, flows back in the reverse direction through the space, and is collected. This structure doubles the path of cooling water to provide a high cooling effect and save the piping of cooling water.

It is noted that the number of the work carrier bars 201 is determined depending on the number of the work support bars 106 of the furnace unit, and it is preferable that the number of the work carrier bars 201 is more than the number of the work support bars 106 by one bar.

As described above, a multistage furnace in which a plurality of furnace units are piled up in the vertical direction, and thus the installation area of the furnace is decreased. Since each of the furnace units functions as an independent furnace, even when one furnace unit is broken, the other furnace units are not influenced by it. Furthermore, the size of one furnace unit in the vertical direction is decreased, and thus the whole size of the furnace in the vertical direction is decreased. Also, the support pipe is configured so as to flow cooling water therethrough, thereby preventing the heat deformation.

What is claimed is:

1. A multistage furnace comprising a plurality of furnace units piled up in a vertical direction, the furnace units each comprising:

an upper heater and a lower heater that have a shape of a plate and are layered in the vertical direction, the plate having a first edge and a second edge opposite from the first edge;

a first support pipe disposed on and extending along the first edge;

a second support pipe disposed on and extending along the second edge; and a plurality of work support bars disposed over the first and second support pipes and configured to support a work, wherein the upper heater of one of the furnace units is configured to heat a back surface of the work supported by the work support bars, and the lower heater of a furnace unit that is placed on the one of the furnace units is configured to heat a front surface of the work supported by the work support bars.

2. The multistage furnace of claim 1, further comprising a heat insulator disposed between the upper heater and the lower heater.

3. The multistage furnace of claim 1, the furnace units each further comprising a plurality of first support stands mounted on the first support pipe at a predetermined interval and comprising concave portions in upper surfaces thereof, and a plurality of second support stands mounted on the second support pipe at a predetermined interval and comprising concave portions in upper surfaces thereof, wherein the work support bars are fitted in the concave portions of corresponding first and second support stands.

4. The multistage furnace of claim 1, wherein the upper heater and the lower heater comprise far-infrared heaters.

5. The multistage furnace of claim 1, wherein the first and second support pipes are configured so as to flow cooling water therethrough.

6. The multistage furnace of claim 5, wherein each of the first and second support pipes comprises an outer pipe having a closed end and an open end, an inner pipe having two open ends and inserted in the outer pipe with a space therebetween, and a cooling water injection device injecting cooling water from an end of the inner pipe into the inner pipe so that the injected cooling water that is discharged and flows back in a reverse direction through the space.

* * * * *